US008777648B2

(12) United States Patent
Kitajima et al.

(10) Patent No.: US 8,777,648 B2
(45) Date of Patent: Jul. 15, 2014

(54) ELECTRICAL CONNECTOR WITH EASILY SEPARABLE INNER AND OUTER HOUSINGS

(75) Inventors: Mitsunori Kitajima, Yokkaichi (JP); Youjirou Hashimoto, Yokkaichi (JP); Kazuo Nakai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 97 days.

(21) Appl. No.: 13/485,099

(22) Filed: May 31, 2012

(65) Prior Publication Data

US 2012/0309234 A1 Dec. 6, 2012

(30) Foreign Application Priority Data

Jun. 6, 2011 (JP) ..... 2011-126371

(51) Int. Cl.
*H01R 13/52* (2006.01)

(52) U.S. Cl.
USPC ..... 439/271; 439/587; 439/595

(58) Field of Classification Search
USPC ..... 439/660, 271, 586, 587, 752, 595
See application file for complete search history.

(56) References Cited

U.S. PATENT DOCUMENTS

| | | | | |
|---|---|---|---|---|
| 6,575,788 | B2 * | 6/2003 | Nimura et al. | 439/595 |
| 6,626,702 | B2 * | 9/2003 | Kurimoto et al. | 439/595 |
| 7,727,016 | B2 * | 6/2010 | Lamdiziz et al. | 439/587 |
| 8,251,743 | B2 * | 8/2012 | Sakamoto et al. | 439/595 |
| 2005/0245130 | A1 * | 11/2005 | Shiga et al. | 439/587 |
| 2010/0273353 | A1 * | 10/2010 | Yahya et al. | 439/587 |
| 2011/0256752 | A1 * | 10/2011 | Sakamoto et al. | 439/370 |

FOREIGN PATENT DOCUMENTS

JP 2010-153072 7/2010

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A connector includes a one-piece rubber plug (30) arranged to cover a rear surface (10R) of an inner housing (10) and has seal holes (31) aligned with cavities 12. An outer housing (20) has a tubular portion (21) surrounding the inner housing (10) and a rear wall (24) covering a rear surface (30R) of the one-piece rubber plug (30). The rear wall (24) has insertion holes (25) aligned with the seal holes (31). Locking holes (26A, 26B) are open on a rear surface (24R) of the rear wall (24), and locks (17A, 17B) on the inner housing (10) engage with the locking holes (26A, 26B) to lock the housings (10, 20) in an assembled state.

14 Claims, 6 Drawing Sheets

ELECTRICAL CONNECTOR WITH EASILY SEPARABLE INNER AND OUTER HOUSINGS

BACKGROUND OF THE INVENTION

1. Field of the Invention

The invention relates to a connector.

2. Description of the Related Art

Japanese Unexamined Patent Publication No. 2010-153072 discloses a connector formed by assembling an inner housing, an outer housing, terminal fittings and a one-piece rubber plug. Cavities are formed in the inner housing and the terminal fittings are inserted into the respective cavities from behind. The outer housing includes a tubular portion that surrounds the inner housing and a rear wall with insertion holes corresponding to the respective cavities. The one-piece rubber plug is mounted to cover the rear surface of the inner housing and has seal holes that align with the cavities. The rear wall is arranged to cover the rear surface of the one-piece rubber plug so that the insertion holes align with the seal holes.

The inner and outer housings are locked together by engaging a resilient locking piece on the outer periphery of a rear end part of the inner housing with a locking recess formed on the inner periphery of the tubular portion of the outer housing. The resilient locking piece is surrounded by the tubular portion of the outer housing. As a result, the resilient locking piece cannot be deformed to be disengaged from the locking recess from the outside of the outer housing.

The invention was completed in view of the above situation and an object thereof is to improve overall operability by easily unlocking a locking means for locking an inner housing and an outer housing in an assembled state.

SUMMARY OF THE INVENTION

The invention relates to a connector with an inner housing formed with cavities that are open on a rear surface. Terminal fittings are inserted into the respective cavities from behind. A resilient plug partly covers the rear surface of the inner housing and has seal holes that align with the respective cavities. An outer housing includes a tubular portion at least partly surrounding the inner housing and a rear wall at least partly covering the rear surface of the resilient plug. The rear wall has insertion holes that align with the respective seal holes. At least one locking hole is formed to be open on the rear surface of the rear wall. At least one lock is formed on the inner housing and can engage with the locking hole to lock the inner and outer housings in an assembled state.

The lock may be deformed resiliently from behind to be disengaged from the locking hole, thereby releasing the locked state between the lock and the locking hole. The locking hole engaged with the lock is open on the rear surface of the rear wall. Thus, operability in disengaging the lock and the locking hole is excellent. Further, the engaged state of the lock and the locking hole easily can be confirmed visually.

An opening area of the insertion hole and an opening area of the locking hole on the rear surface of the rear wall preferably are substantially continuous and flush with each other. Thus, the rear surface of the rear wall is flat over a wide area and shape simplification can be achieved.

At least one step-like receiving portion is formed on the inner periphery of the locking holes and the lock can be engaged with the receiving portion. Thus, a rear end part of the lock need not project from the rear surface of the rear wall.

Rear surfaces of the rear wall and the inner housing preferably are substantially rectangular and two locking holes preferably are provided along each of two parallel sides to each other.

A space between the locking holes along one side and a space between the locking holes along the other side differ. Thus, the locks and the locking holes do not match if the housings are attempted to be assembled in improper inverted postures so that assembling in improper postures can be prevented.

The lock and the rear wall preferably are set in different colors. Thus, the presence of the lock on the rear surface of the rear wall can be seen easily. This enables easy confirmation of the engaged state of the lock.

The inner housing preferably comprises a tubular accommodating portion to accommodate the resilient plug.

A radial dimension of an area of the locking hole before a receiving surface of the receiving portion is smaller than the radial dimension of the lock and substantially equal to or slightly smaller than the thickness of the tubular accommodating portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

A connector in accordance with one particular embodiment of the invention includes an inner housing 10, terminal fittings 13, an outer housing 20 and a one-piece resilient or rubber plug 30.

Figure 1:
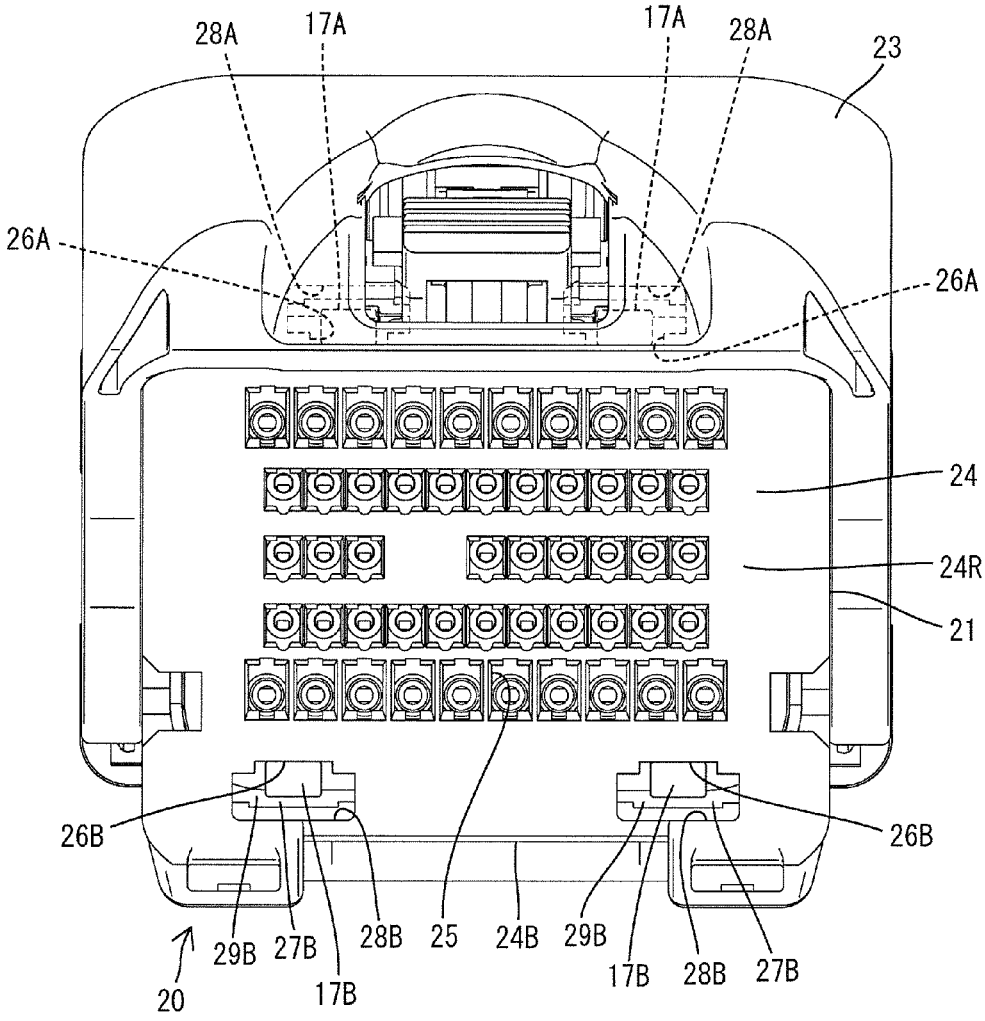
FIG. 1 is a front view of a connector according to one embodiment.
Figure 2:
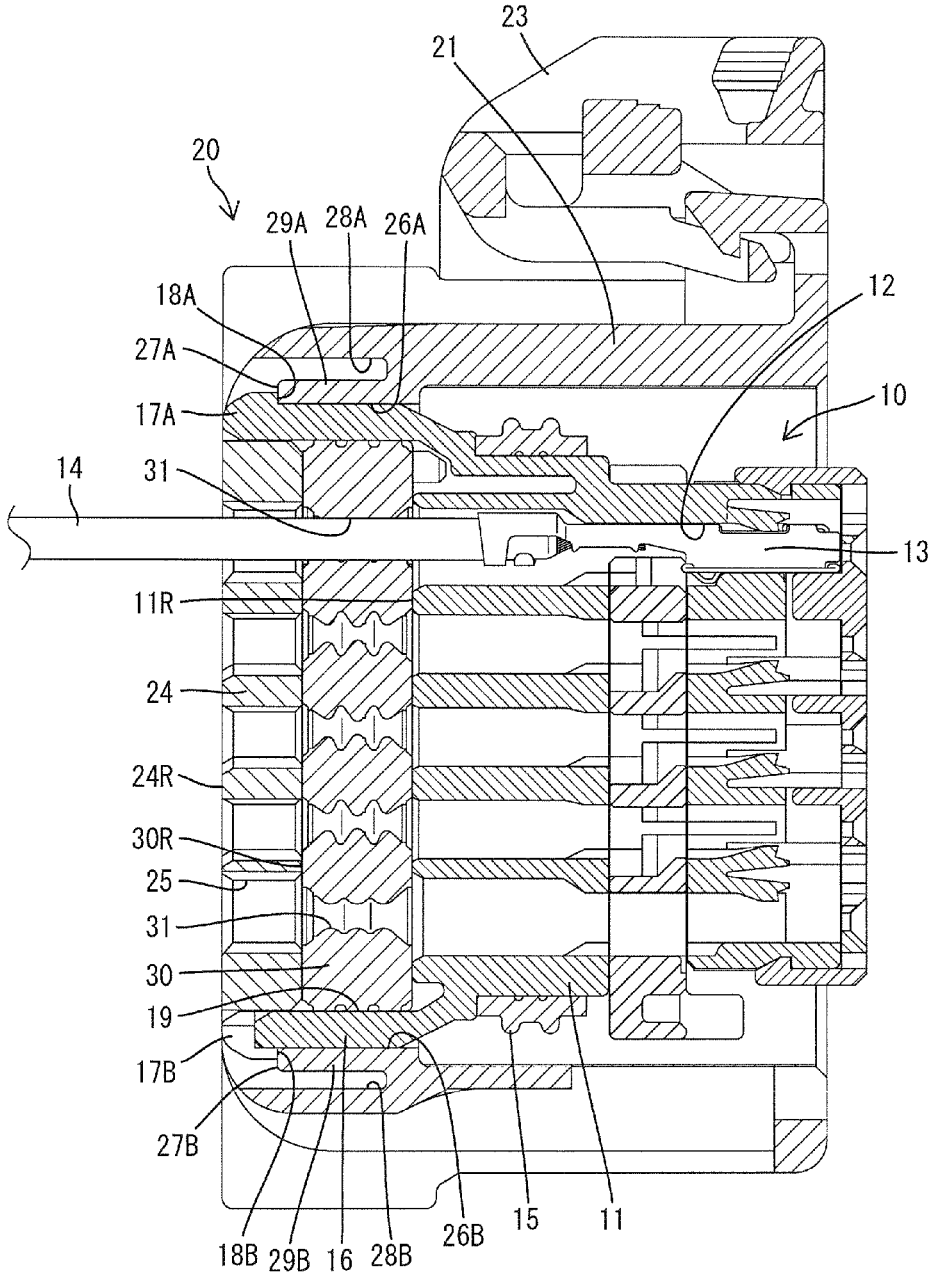
FIG. 2 is a section of the connector.
Figure 4:
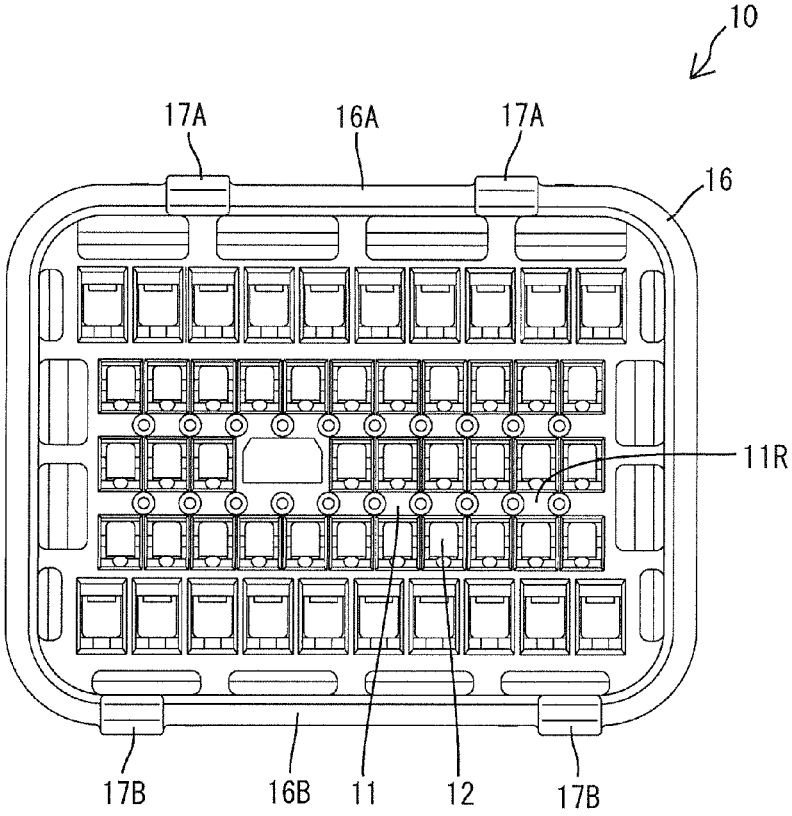
FIG. 4 is a rear view of an inner housing.

The inner housing 10 is made unitarily e.g. of synthetic resin and includes a main body 11 has a substantially rectangular rear shape as shown in FIG. 4. and a rectangular tubular accommodating portion 16 projecting back from an outer periphery of a rear surface 11R of the main body 11, as shown in FIG. 2. Cavities 12 penetrate the housing main body 11 in forward and backward directions. The terminal fittings 13 are to be inserted into each cavity 12 from behind. A wire 14 is fixed to a rear end part of the terminal fitting 13. A seal ring 15 is mounted on the outer periphery of the housing main body 11. Further, a sealing surface 19*a* is defined at a front end area on the inner periphery of the tubular accommodating portion 16 and extends substantially from the rear surface 11R of the main body 11 to a position slightly before the rear opening edge of the tubular accommodating portion 16.

Figure 6:
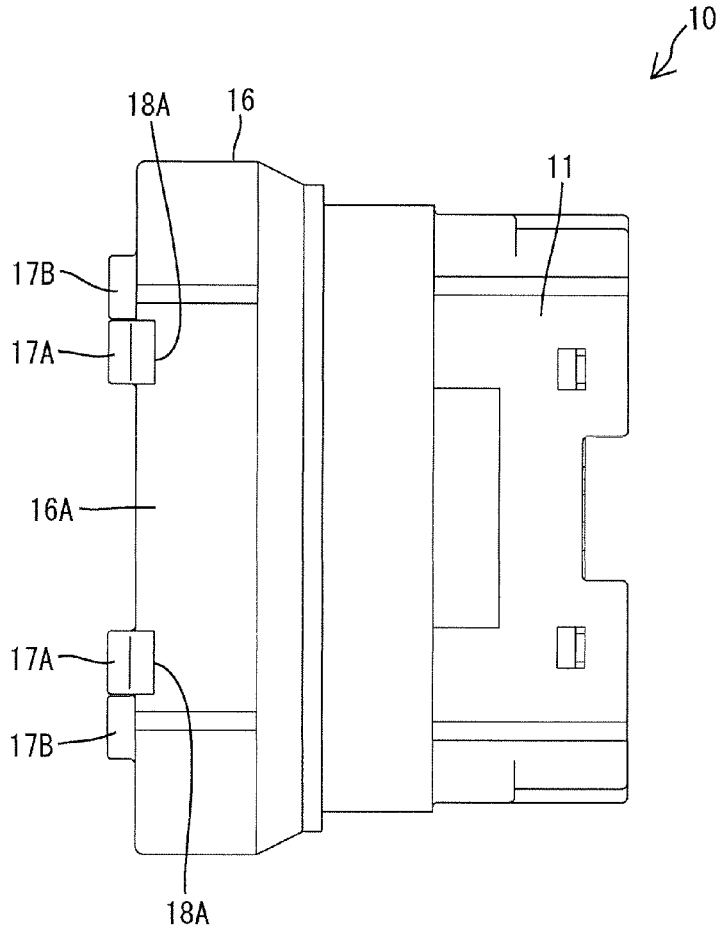
FIG. 6 is a plan view of the inner housing.

As shown in FIGS. 4 and 6, two pairs of locks 17A, 17B are formed on the rear end edge of the tubular accommodating portion 16. More particularly, left and right first locks 17A are formed on an upper side 16A of the tubular accommodating portion 16, and left and right second locks 17B are formed on a lower side 16B. A space between the first locks 17A in a lateral direction is narrower than a space between the second locks 17B.

Figure 5:
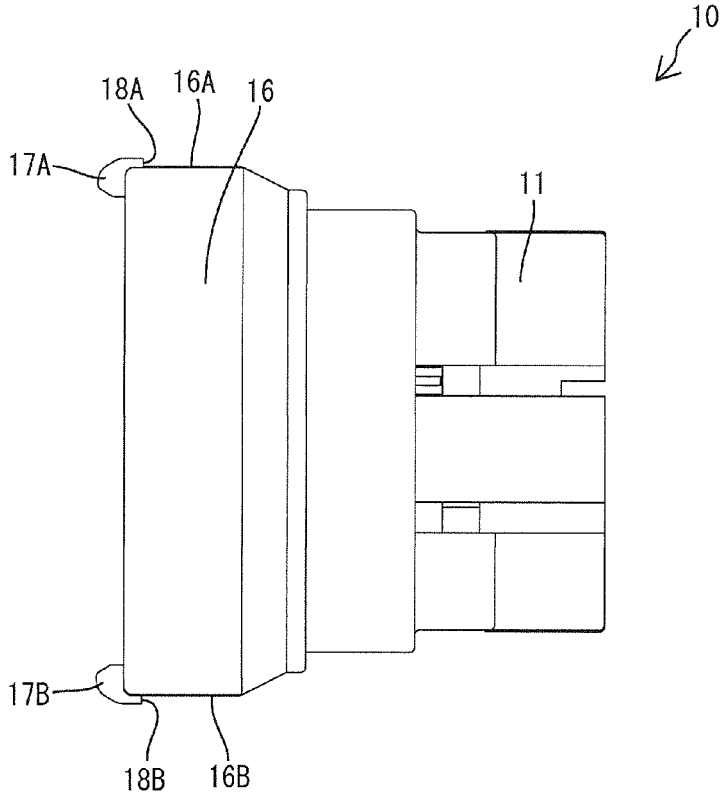
FIG. 5 is a side view of the inner housing.

As shown in FIGS. 5 and 6, the first lock 17A projects back from the rear end edge of the tubular accommodating portion 16 and projects up from the upper surface of the tubular accommodating portion 16. As shown in FIG. 2, the lower surface of the first lock 17A is substantially continuous and flush with the inner surface of the tubular accommodating portion 16. The front surface of a part of the first lock 17A project up or out from the upper or outer surface of the tubular accommodating portion 16 defines a first locking surface 18A that is substantially perpendicular to forward and backward directions. A rear end part of the first lock 17A is tapered to reduce a spacing between the upper and lower surfaces thereof (thickness) toward the rear.

As shown in FIG. 5, the second lock 17B projects back from the rear end edge of the tubular accommodating portion 16 and projects down and out from the lower surface of the tubular accommodating portion 16. As shown in FIG. 2, the upper surface of the second lock 17B is substantially continuous and flush with the inner surface of the tubular accommodating portion 16. As shown in FIG. 5, the front surface of the second lock 17B projects down or out from the lower or outer surface of the tubular accommodating portion 16 and defines a second locking surface 18B substantially perpendicular to forward and backward directions. A rear end part of the second lock 17B is tapered to reduce a spacing between the upper and lower surfaces thereof (thickness) toward the rear.

Figure 3:
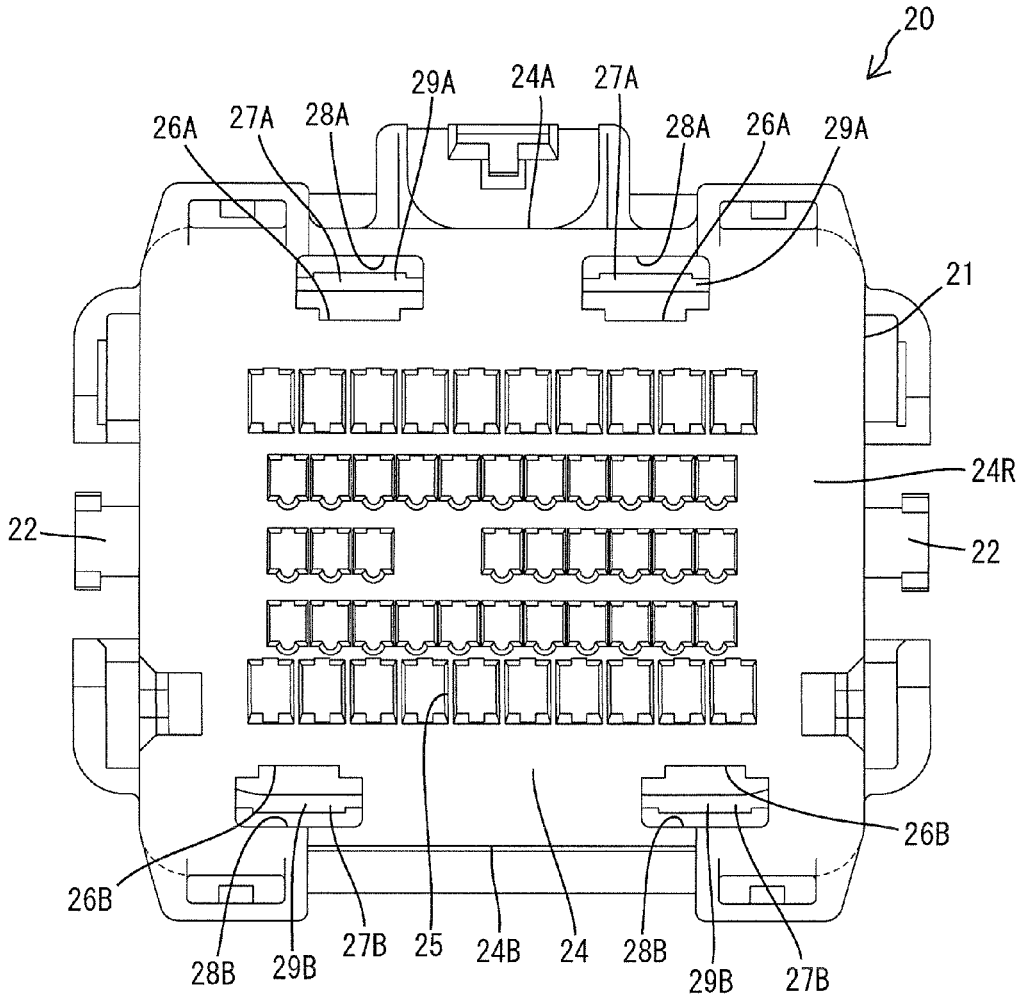
FIG. 3 is a rear view of an outer housing.

The outer housing 20 is made unitarily e.g. of synthetic resin and, as shown in FIG. 2, includes a rectangular tubular portion 21 with an open front and a rear wall 24 covering the rear end of the tubular portion 21. As shown in FIG. 3, a rear surface 24R of the rear wall portion 24 has a substantially rectangular shape similar to the main body 21 and the tubular accommodating portion 16. A lever 23 is mounted rotatably on supporting shafts 22 on left and right walls forming the tubular portion 21 and is an operating member for connecting the connector and a mating connector (not shown).

As shown in FIG. 2, insertion holes 25 penetrate the rear wall 24 in forward and backward directions and are arranged to correspond to the respective cavities 12. As shown in FIG. 3, the rear wall 24 is formed with first and second pairs of locking holes 26A, 26B. More particularly left and right first locking holes 26A are arranged to correspond to the first locks 17A, and left and right second locking holes 26B are arranged to correspond to the second locks 17B. The first locking holes 26A are arranged along an upper side 24A the rear wall 24 and are located outside of a formation area of all the insertion holes 25 in the rear wall 24. The second locking holes 26B are arranged substantially along a lower side 24B of the rear wall 24, and are located outside of the formation area of the insertion holes 25 in the rear wall 24. A lateral spacing between the first locking holes 26A is narrower than that between the second locking holes 26B.

As shown in FIG. 2, first and second receiving portions 27A, 27B are formed respectively in the first and second locking holes 26A, 26B. The first receiving portion 27A is formed by cutting the inner periphery of a rear end part upward in a stepped manner. The rear surface of the first receiving portion 27A defines a receiving surface and is substantially perpendicular to forward and backward directions. A space behind the first receiving portion 27A is open on the rear surface 24R of the rear wall 24. The height of the first locking hole 26A before the receiving surface of the first receiving portion 27A is less than the vertical thickness of the first lock 17A and is substantially equal to or slightly smaller than the thickness of the tubular accommodating portion 16.

The second receiving portion 27B in the second locking hole 26B is formed by cutting the inner periphery of a rear end part down in a stepped manner. The rear surface of the second receiving portion 27B also defines a receiving surface and is substantially perpendicular to forward and backward directions. A space behind the second receiving portion 27B (receiving surface) out of the rear end part of the second locking hole 26B is open on the rear surface 24R of the rear wall 24. The height of an area of the second locking hole 26B before the receiving surface of the second receiving portion 27B is smaller than the vertical thickness of the second lock 17B and substantially equal to or slightly smaller than the thickness of the tubular accommodating portion 16.

As shown in FIG. 2, opening areas of the insertion holes 25 on the rear surface 24R of the rear wall 24 and those of the locking holes 26A, 26B of the rear wall 24 are substantially continuous and flush with each other. Accordingly, since the rear surface 24R of the rear wall 24 is substantially flat over substantially the entire area, shape simplification is realized.

As shown in FIGS. 2 and 3, the rear wall 24 is formed with two pairs of operation holes 28A, 28B that are laterally wide slits formed in the rear surface 24R and deep in the forward direction with a closed front end. Specifically, two first operation holes 28A are arranged above and near the first locking holes 26A, and horizontal plate-shaped first partition walls 29A (including the first receiving portions 27A) partition between the first locking holes 26A and the first operation holes 28A. Rear ends of the first operation holes 28A and rear ends of the first locking holes 26A communicate via the spaces behind the first receiving portions 27A. Thus, on the rear surface 24R of the rear wall 24, the first locking holes 26A (including the spaces behind the first receiving portions 27A) and the first operation holes 28A are open while communicating with each other, as shown in FIG. 3.

Two second operation holes 28B are arranged below and near the second locking holes 26B, and horizontal plate-shaped second partition walls 29B (including the second receiving portions 27B) partitioning between the second locking holes 26B and the second operation holes 28BA. Rear ends of the second operation holes 28B and rear ends of the second locking holes 26B communicate via the spaces behind the second receiving portions 27B. Thus, on the rear surface 24R of the rear wall portion 24, the second locking holes 26B (including the spaces behind the second receiving portions 27B) and the second operation holes 28B are substantially open while communicating with each other.

A rear surface 30R of the one-piece rubber plug 30 has a substantially rectangular shape similar to the main body 11, the tubular accommodating portion 16 and the rear wall 24. As shown in FIG. 2, seal holes 31 penetrate the one-piece rubber plug 30 in forward and backward directions and correspond to the respective cavities 12 and the respective insertion holes 25. Lips are formed on the inner periphery of each seal hole 31 and on the outer periphery of the one-piece rubber plug 30. The one-piece rubber plug 30 is to be accommodated into the tubular accommodating portion 16 from behind and mounted to at least partly cover the rear surface 11R of the main body 11 (inner housing 10). The lips on the outer periphery of the one-piece rubber plug 30 are held in close contact with the sealing surface 19 of the tubular accommodating portion 16 in a fluid- or liquid-tight manner when the one-piece rubber plug 30 is mounted in the inner housing 10.

The inner and outer housings 10, 20 are assembled by inserting the inner housing 10 into the tubular portion 21 of the outer housing 20 from the front. A rear end of the tubular portion 21 is mounted on the tubular accommodating portion 16 when the housings 10, 20 are assembled so that relative displacements of the housings 10, 20 in vertical and lateral directions (directions crossing an assembling direction of the housings 10, 20) are prevented. Further, the rear end of the tubular accommodating portion 16 is held in contact with the front surface of the rear wall 24 from the front so that backward displacement of the inner housing 10 relative to the outer housing 20 is prevented.

The respective locks 17A, 17B fit into the locking holes 26A, 26B in the process of assembling the housings 10, 20. More particularly, the substantially wedge-shaped rear end parts of the locks 17A, 17B initially are inserted into the locking holes 26A, 26B. As the locks 17A, 17B are inserted, the partition walls 29A, 29B partitioning between the locking holes 26A, 26B and the operation holes 28A, 28B are deformed resiliently to escape toward the operation holes 28A, 28B. The locks 17A, 17B that are fit to substantially proper insertion positions pass the partition walls 29A, 29B and engage the receiving portions 27A, 27B so that the partition walls 29A, 29B resiliently restore toward the locking holes 26A, 26B. Thus, the locking surfaces 18A, 18B of the locks 17A, 17B engage the receiving surfaces of the locking holes 26A, 26B from behind.

The engagement of the locks 17A, 17B and the locking holes 26A, 26B prevents a forward displacement of the inner housing 10 relative to the outer housing 20. Further, the receiving portions 27A, 27B locked by the locks 17A, 17B are formed by recessing the inner peripheries of the locking holes 26A, 26B in a stepped manner, and substantially the entire locks 17A, 17B are accommodated in the locking holes 26A, 26B. As a result, the rear end parts of the locks 17A, 17B need not project out (backward) from the rear surface 24R of the rear wall 24, and the housings 10, 20 are held in the assembled state.

The rear wall 24 covers the rear surface 30R of the resilient plug 30 when the housings 10, 20 are assembled and the insertion holes 25 are located to correspond to the seal holes 31. The wires 14 extending back from the terminal fitting 13 pass through the seal hole 31 and a clearance between the outer periphery of the wire 14 and the inner periphery of the seal hole 31 is sealed in a fluid- or liquid-tight manner. Note that, in inserting the terminal fitting 13 into the cavity 12, the terminal fitting 13 successively passes through the insertion hole 25 and the seal hole 31.

The locks 17A, 17B that lock the housings 10, 20 in the assembled state can be seen from behind the rear wall 24 when accommodated in the rearwardly open locking holes 26A, 26B. While the housings 10, 20 are being assembled, the partition walls 29A, 29B are displaced resiliently toward the operation holes 28A, 28B and the partition walls 29A, 29B (receiving portions 27A, 27B) in substantially the entire thickness area can be located substantially side by side with the locks 17A, 17B and seen. Further, the partition walls 29A, 29B are restored resiliently when the housings 10, 20 are assembled completely. Thus, parts of the partition walls 29A, 29B (receiving portions 27A, 27B) are hidden behind the locks 17A, 17B and cannot be seen. Thus, the assembled state of the housings 10, 20 (engaged states of the locks 17A, 17B and the locking holes 26A, 26B) can be detected based on a positional relationship of the partition walls 29A, 29B and the receiving portions 27A, 27B and whether or not the partition walls 29A 29B can be seen entirely.

A jig (not shown) can be inserted into the operation hole 28A, 28B from behind to disengage the locks 17A, 17B and the receiving portions 27A, 27B so that the housings 10, 20 can be separated. A flat-head screwdriver or something having a similar shape can be used as the jig. The tip of the jig is inserted to the back end of the operation hole 28A, 28B, and the jig is inclined in a direction away from the locking hole 26A, 26B about the back end of the operation hole 28A, 28B. The operation hole 28A, 28B pressed by the jig is displaced away from the locking hole 26A, 26B and the partition wall 29A, 29B and the receiving portions 27A, 27B also are displaced away from the locking hole 26A, 26B, following the operation hole 28A, 28B. The displaced receiving portion 27A, 27B is disengaged from the lock 17A, 17B to release the locked state. In this embodiment, the locking holes 26A, 26B to be engaged with the locks 17A, 17B are open on the rear surface 24R of the rear wall 24. Thus, operability in releasing the locked state between the locks 17A, 17B and the locking holes 26A, 26B is excellent.

The rear surface 24R of the rear wall 24 and the rear surface 11R of the inner housing 10 are substantially rectangular and pairs of locking holes 26A and 26B are provided respectively along the substantially parallel upper and lower sides 24A and 24B. The spacing between the first locking holes 26A along the upper side 24A is different from the spacing between the second locking holes 26B along the lower side 24B. Accordingly, the inner and outer housings 10 and 20 cannot be assembled in improper (e.g. inverted) postures because the locks 17A, 17B and the locking holes 26A, 26 do not match and cannot be engaged.

The inner and outer housings 10 and 20 are set in different colors. Accordingly the locks 17A, 17B formed on the inner housing 10 and the rear wall 24 of the outer housing 20 are in different colors and the presence of the locks 17A, 17B on the rear surface 24R of the rear wall 24 can be seen easily and reliably to enable easy confirmation of the engaged state of the locks 17A, 17B.

The invention is not limited to the above described embodiment, and the following embodiments are also included in the scope of the invention.

The one-piece rubber plug is held in close contact with the inner peripheral surface of the tubular accommodating portion of the inner housing and the locks are formed on the rear end of the tubular accommodating portion in the above embodiment. However, the one-piece rubber plug may be held in close contact with the inner peripheral surface of a tubular accommodating portion formed in the outer housing, a tubular portion of the inner housing may be fit on the outer periphery of this tubular accommodating portion and the locks may be formed on the rear end edge of the tubular portion.

The locks are engaged with the receiving portions on the inner peripheries of the locking holes in the above embodiment, but they may be engaged with hole edge portions of the locking holes on the rear surface of the rear wall.

Although the rear wall and the tubular portion of the outer housing are formed unitarily in the above embodiment, they may be separate parts.

Although the opening areas of the insertion holes and those of the locking holes on the rear surface of the rear wall portion are continuous and flush with each other, they may be connected via one or more steps.

Two locks are provided along each of two parallel sides of the rear wall in the above embodiment. However, the number and arrangement of the locking holes may vary.

Although the locks and the rear wall are set in different colors in the above embodiment, they may be in the same color.

The locking holes are disengaged from the locks by resiliently displacing the partition walls forming the locking holes in releasing the locked state between the locks and the locking holes in the above embodiment. However, the locks may be displaced resiliently to be disengaged from the locking holes.

What is claimed is:

1. A connector, comprising:

an inner housing formed with at least one cavity open on a rear surface;

at least one terminal fitting to be inserted into the cavity from behind;

a resilient plug positioned on the rear surface of the inner housing, the resilient plug having an outer periphery and at least one seal hole inward of the outer periphery and aligned with the cavity;

an outer housing including a tubular portion at least partly surrounding the inner housing and a rear wall arranged to at least partly cover the rear surface of the resilient plug and having at least one insertion hole aligned with the seal hole;

at least one locking hole formed to be open at a position on a rear surface of the rear wall outward of the outer periphery of the resilient plug; and at least one resilient lock formed on the inner housing, the resilient lock being cantilevered to a position rearward and outward of the resilient plug and being engageable with the locking hole to lock the inner and outer housings in an assembled state.

2. The connector of claim 1, wherein an opening area of the insertion hole and an opening area of the locking hole on the rear surface of the rear wall are substantially continuous and flush with each other.

3. The connector of claim 1, wherein:

at least one step-like receiving portion is formed on an inner periphery of the locking hole; and the lock being engageable with the receiving portion.

4. The connector of claim 2, wherein:

the rear surfaces of the rear wall and the inner housing are substantially rectangular; and two locking holes are provided along each of first and second parallel sides of the rear wall.

5. The connector of claim 4, wherein a spacing between the locking holes along the first side and a spacing between the locking holes along the second side differ.

6. The connector of claim 1, wherein the lock and the rear wall are set in different colors.

7. The connector of claim 3, wherein the inner housing comprises a tubular accommodating portion accommodating the resilient plug.

8. The connector of claim 7, wherein a cross sectional dimension of an area of the locking hole before a receiving surface of the receiving portion and measured transverse to an insertion direction of the lock into the locking hole is smaller than the cross sectional dimension of the lock measured transverse to the inserting direction.

9. The connector of claim 8, wherein a cross sectional dimension of an area of the locking hole before a receiving surface of the receiving portion is substantially equal to or slightly smaller than a wall thickness of the tubular accommodating portion.

10. A connector, comprising:

an outer housing including a rear wall with a front surface and a tubular portion projecting forward from the rear wall, insertion holes and locking holes formed through the rear wall, the insertion holes being at positions on the rear wall inward from the locking holes, receiving steps being formed on peripheries of the locking holes;

a resilient plug positioned on an area of the front surface of the rear wall of the outer housing and having an outer periphery inward of the locking holes in the rear wall of the outer housing, the resilient plug having seal holes aligned respectively with insertion holes; and an inner housing with a main body having opposite front and rear ends and cavities extending through the main body from the front end to the rear end, the main body being disposed in the tubular portion of the outer housing so that the cavities align respectively with the insertion holes in the rear wall of the outer housing and with the seal holes of the resilient plug, a plurality of resilient locks cantilevered rearward from the rear end of the main body at positions outward of the outer periphery of the resilient plug and being disposed in the locking holes formed through the rear wall of the outer housing so that the locks engage the receiving steps of the respective locking holes for locking the inner and outer housings together, rear ends of the locks being accessible from outside the outer housing for selectively unlocking the inner and outer housings.

11. The connector of claim 10, further comprising terminal fittings disposed respectively in the cavities of the inner housing.

12. The connector of claim 10, wherein:

the rear wall and the rear end of the main body of the inner housing are substantially rectangular; and two locking holes are provided along each of first and second parallel sides of the rear wall.

13. The connector of claim 12, wherein a spacing between the locking holes along the first side and a spacing between the locking holes (26B) along the second side are different from one another.

14. The connector of claim 10, wherein the locks and the rear wall are of different colors.

* * * * *